US006386830B1

(12) United States Patent
Slipper et al.

(10) Patent No.: US 6,386,830 B1
(45) Date of Patent: May 14, 2002

(54) QUIET AND EFFICIENT HIGH-PRESSURE FAN ASSEMBLY

(75) Inventors: Michael E. Slipper, Blackwood, NJ (US); Yu-Tai Lee, McLean, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/804,648

(22) Filed: Mar. 13, 2001

(51) Int. Cl.[7] ..... F04D 29/38; F01D 5/00; F01D 9/02

(52) U.S. Cl. ..... 415/211.2; 416/203; 416/223 R

(58) Field of Search ..... 415/119, 208.1, 415/208.2, 211.2; 416/223 R, 223 A, 175, 203

(56) References Cited

U.S. PATENT DOCUMENTS 2,962,260 A * 11/1960 Foley ..... 416/223 A X
3,006,603 A * 10/1961 Caruso et al. ..... 415/119 X
3,367,423 A * 2/1968 Van Ranst ..... 416/223 R X
3,873,229 A * 3/1975 Mikolajczak et al. ..... 415/119
3,995,970 A 12/1976 Nobuyuki ..... 415/119
4,131,387 A 12/1978 Kazin et al. ..... 415/119
4,431,376 A 2/1984 Lubenstein et al. ..... 416/223 A
4,474,534 A * 10/1984 Thode ..... 416/203
4,508,486 A * 4/1985 Tinker ..... 415/119
4,995,787 A * 2/1991 O'Connor ..... 415/119 X
5,000,660 A * 3/1991 Van Houten et al. ..... 416/203
5,167,489 A * 12/1992 Wadia et al. ..... 415/211.2 X
5,169,288 A * 12/1992 Gliebe et al. ..... 415/119
5,184,938 A 2/1993 Harmsen ..... 416/223 R
5,478,199 A 12/1995 Gliebe ..... 415/119
5,681,145 A * 10/1997 Neely et al. ..... 416/203
5,785,495 A * 7/1998 Springer et al. ..... 415/211.2 X
5,984,631 A * 11/1999 Tolgos ..... 415/119 X
6,045,327 A * 4/2000 Amr ..... 415/211.2
6,290,460 B1 * 9/2001 Nagaoka et al. ..... 415/208.2

* cited by examiner

*Primary Examiner*—John E. Ryznic

(57) ABSTRACT

A high-pressure vane-axial fan assembly is provided. A rotor assembly has a plurality of rotor blades disposed circumferentially around and extending radially outward from a hub. Each rotor blade has an airfoil cross-section and is constructed to define a straight-ruled leading edge that extends outward from the hub. The rotor blade is rotated along its span relative to the straight-ruled leading edge. The plurality of rotor blades defines a solidity of greater than 1. A stator assembly has a plurality of stator vanes disposed circumferentially around and extending radially from the frame. There are a lesser number of stator vanes than rotor blades. The stator assembly is positioned adjacent the rotor assembly such that an axial gap is defined between the trailing edge of the rotor blades and the leading edge of the stator vanes. The axial gap increases with radial distance from the hub as defined by the shape of the trailing edge of the rotor blades and the shape of the leading edge of the stator vanes. The axial gap is a minimum of the rotor blade's axial chord length along a central portion thereof.

35 Claims, 4 Drawing Sheets

FIG. 1
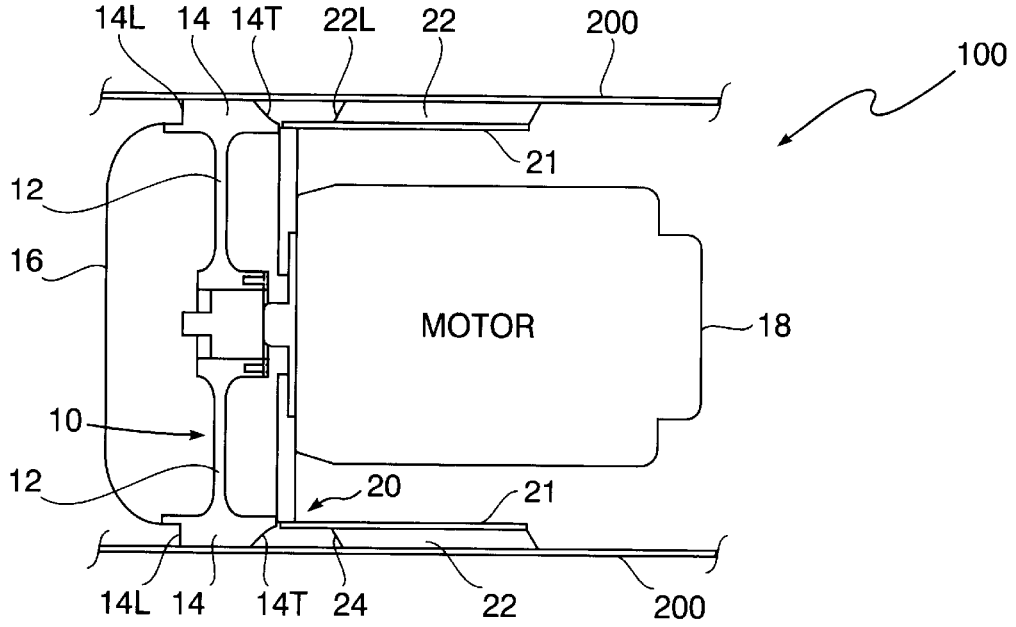
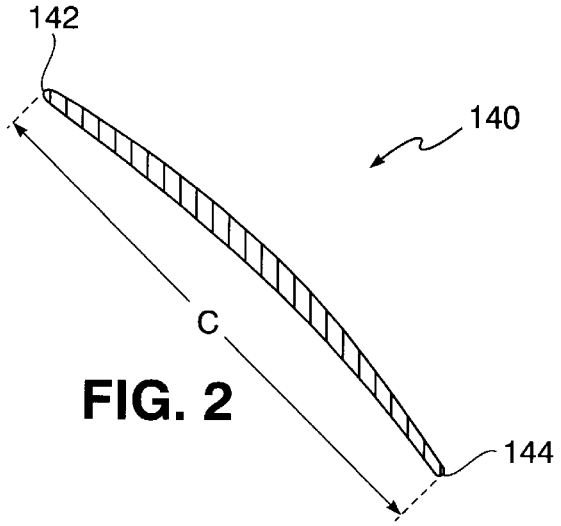
FIG. 2
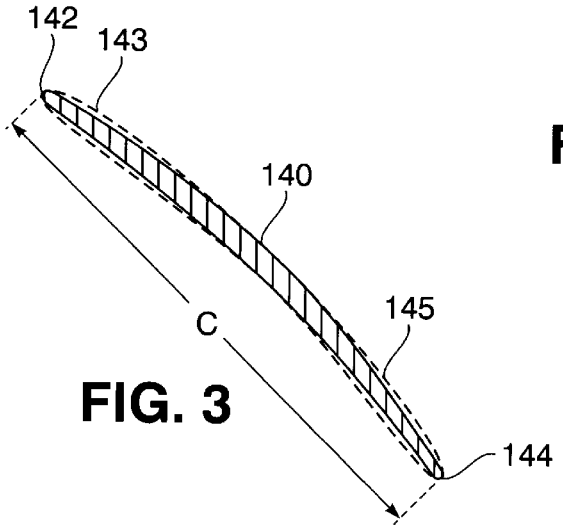
FIG. 3

FIG. 4
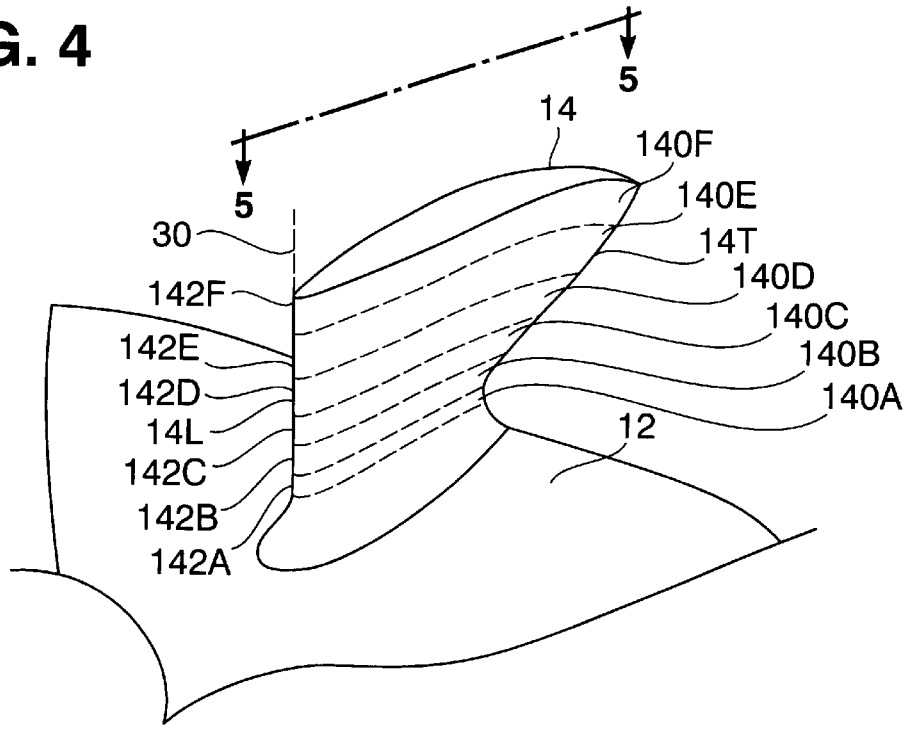
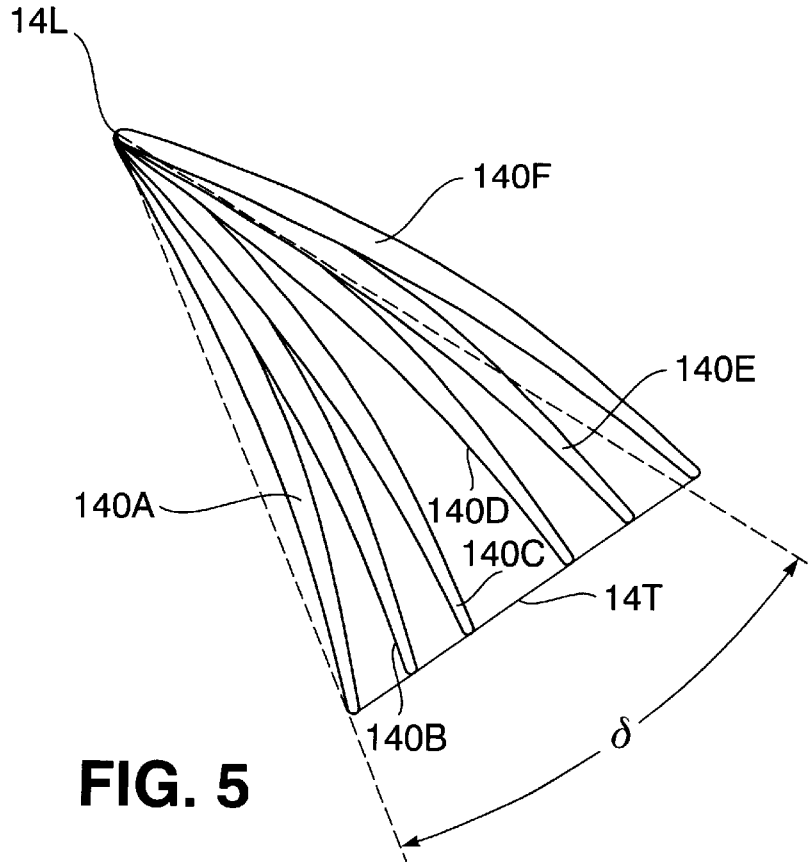
FIG. 5

QUIET AND EFFICIENT HIGH-PRESSURE FAN ASSEMBLY

ORIGIN OF THE INVENTION

The invention described herein was made in the performance of official duties by employees of the Department of the Navy and may be manufactured, used, licensed by or for the Government for any governmental purpose without payment of any royalties thereon.

CROSS-REFERENCE TO RELATED PATENT APPLICATIONS

This patent application is co-pending with one related patent application entitled "FAN ROTOR WITH CONSTRUCTION AND SAFETY PERFORMANCE OPTIMIZATION" (Navy Case No. 82986), filed on the same date and owned by the same assignee as this patent application.

FIELD OF THE INVENTION

The invention relates generally to vane-axial fan assemblies, and more particularly to a high-pressure axial flow fan assembly that is aerodynamically more efficient and quieter than current designs.

BACKGROUND OF THE INVENTION

U.S. Navy ships incorporating the Collective Protection System (CPS) in their ventilation system design use vane-axial (in-line duct) supply fans that are required to develop pressures that are substantially greater than those developed by conventional ventilation system fans. These CPS high-pressure ventilation supply fans are designed to overcome normal system pressure losses as well as pressure losses associated with a series of specialized air filters. In addition, the typical CPS supply fan must also be capable of maintaining a pressurized zone within the ship's hull.

Current U.S. Navy CPS ventilation systems use conventional fan technology in terms of rotor blade and stator vane configurations. That is, rotor blades are typically based on profiles of blended circular arcs that are not necessarily the most efficient from an aerodynamic perspective, and not the quietest from an aero-acoustic perspective. Aerodynamic inefficiencies and noise sources in the high-pressure fan assemblies include rotor blade vortex generation, flow separation from both rotor blades and stator vanes, and the interaction of the air as it transitions from rotor blades to stator vanes. The conventional solution for a low efficiency fan design involves the use of a higher horsepower fan motor to perform the aerodynamic work. The conventional solution used to keep the airborne noise levels within the required U.S. Navy specification for allowable space noise levels involves the use of a greater amount of acoustic attenuation material. Neither of these conventional solutions is desirable.

SUMMARY OF THE INVENTION

Accordingly, it is an object of the present invention to provide a fan assembly having increased efficiencies and lower noise levels as compared to current high-pressure fan designs.

Another object of the present invention is to provide a fan assembly having an improved rotor blade design.

Still another object of the present invention is to provide a fan assembly having an improved rotor-to-stator configuration to reduce noise as air transitions from rotor blades to stator vanes.

Other objects and advantages of the present invention will become more obvious hereinafter in the specification and drawings.

In accordance with the present invention, a fan assembly includes a hub defining an axis of rotation. A plurality of rotor blades are disposed circumferentially around and extend radially outward from the hub. Each rotor blade is constructed to define a straight-ruled leading edge that extends outward from the hub. There is unequal angular spacing between leading edges of adjacent ones of the rotor blades. Each rotor blade has a trailing edge that extends from the hub at a skew angle measured in a radial plane of the hub with respect to a first line extending radially outward from the axis of rotation. Each rotor blade has an axial chord length defined across a central portion thereof parallel to the hub's axis of rotation. The plurality of rotor blades further defines a solidity of greater than 1. A plurality of stator vanes are disposed circumferentially around and extend radially from a frame. There are a lesser number of stator vanes than rotor blades. Each stator vane has a leading edge that extends from the frame at: i) an inclined angle measured in the radial plane with respect to a second line extending radially outward from the axis of rotation, and ii) a lean angle measured in an axial plane of the frame with respect to a third line extending radially outward from the axis of rotation. The frame with its stator vanes is positioned adjacent hub and rotor blades such that an axial gap is defined between the trailing edge of the rotor blades and the leading edge of the stator vanes. The axial gap increases with radial distance from the hub as defined by the skew angle and inclined angle. The axial gap is a minimum of the rotor blade's axial chord length.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein:

FIG. 1 is a schematic sectional view of an embodiment of a fan assembly according to the present invention;

FIG. 2 is a cross-sectional view of one of the rotor blades depicting the airfoil shape used in the present invention;

FIG. 3 is a cross-sectional view of one of the rotor blades based on the NACA-65 airfoil shape with its leading and trailing edges defined by a C4 profile;

FIG. 4 is a perspective view of one rotor blade;

FIG. 5 is a top view of the rotor blade taken along line 5—5 of FIG. 4 and depicting the rotation of imaginary airfoil sections about the rotor blade's straight line leading edge;

DETAILED DESCRIPTION OF THE INVENTION

Figure 6:
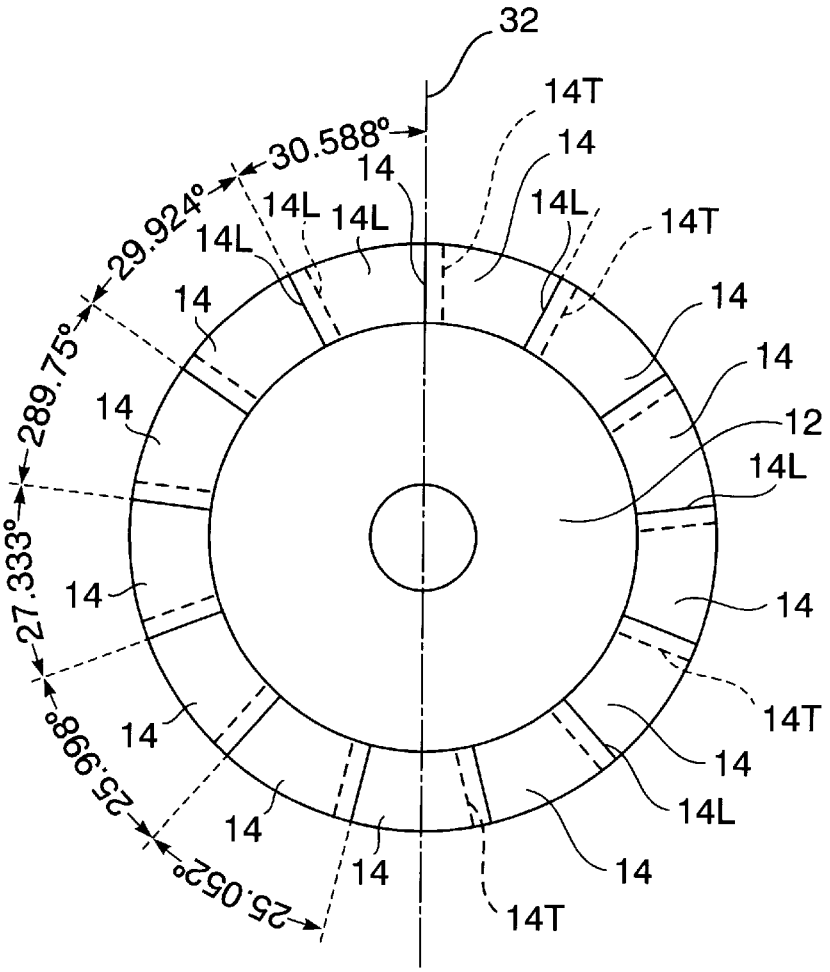
FIG. 6 is a front or axial view of one embodiment of a rotor assembly in accordance with the present invention illustrating the angular spacing and overlap between adjacent rotor blades.

Referring now to the drawings, and more particularly to FIG. 1, the basic layout of a fan assembly according to the present invention is shown and referenced generally by numeral 100. Fan assembly 100 is fitted within a duct 200 such that the fan assembly's rotor assembly 10 is free to rotate therein. Rotor assembly 10 has a hub 12 with a radial cross-section defined by an I-beam. A plurality of rotor blades 14 are attached at the hub's periphery and extend radially outward therefrom. A spinner or nose cone 16 is attached to the forward portion of rotor assembly 10 to transition the inlet airflow into the rotor blade row. A motor 18 is coupled to the central portion of hub 12 and is structurally supported by a stator assembly 20 which is mounted just aft of rotor assembly 10. If necessary, motor 18 can be additionally supported by support rods (not shown) extending radially outward from the rear of motor 18 to the fan housing.

Assembly 20 has a motor/stator case 21 with a plurality of stator vanes 22 mounted thereto about the periphery of case 21. As will be explained further below, stator vanes 22 are spaced axially away from rotor blades 14. The present invention incorporates a combination of structural features resulting in a high-pressure vane-axial fan assembly that is more efficient and quieter than conventional designs. The various structural features include the design of each rotor blade 14 to include its cross-sectional shape as well as its overall shape, the arrangement of rotor blades 14 about hub 12, the spacing relationship between rotor blades 14 and stator vanes 22, and the number of rotor blades 14 and stator vanes 22.

The cross-sectional shape serving as the basis for each of rotor blades 14 is an airfoil. That is, as illustrated in FIG. 2, any radial cross-section of rotor blade 14 will be an airfoil shape 140 having a leading edge 142 and a trailing edge 144 with a chord length C defined as the straight-line distance between leading edge 142 and trailing edge 144. In a preferred embodiment of the present invention, airfoil shape 140 is based on the National Advisory Committee for Aeronautics (NACA) 65 series airfoil shape. The specifications for the NACA-65 series airfoil shape are described in detail in "Summary of Airfoil Data," Ira H. Abbott et al., NACA Report 824, 1945, and in "Theory of Wing Sections Including a Summary of Airfoil Data," Ira H. Abbott et al., Dover Press, New York, 1959.

Airfoil shape 140 can have its leading edge profile and/or its trailing edge profile modified. For example, if airfoil shape 140 is based on the NACA-65 series airfoil shape, one or both the leading and trailing edge profiles can be modified to define a "C4" profile where "C4" defines a thickness form used to cloth a camber line with the known C4 profile shape that is described in "Low Speed Wind Tunnel Tests on a Series of C4 Section Airfoils," N. Ruglen, Aust. Department of Supply, Aeronautic Research Labs, ARL Aero Note 275, 1966, and "Axial Flow Fans and Ducts," R. Allan Wallis, John Wiley & Sons, New York, 1983.

The resulting cross-sectional shape of a rotor blade based on the NACA-65 series airfoil shape with both it's leading and trailing edge profiles modified to have a C4 profile is illustrated in FIG. 3. More specifically, solid line 140 illustrates the basic NACA-65 airfoil shape, dotted line 143 illustrates the C4 leading edge profile modification, and dotted line 145 illustrates the C4 trailing edge profile modification.

As just described, each rotor blade 14 has radial cross-sections defined by an airfoil shape. In other words, each rotor blade 14 can be thought of as a stack of such airfoils beginning at the blade's root and continuing radially outward along the blade's span to the blade's tip. This is best illustrated in FIG. 4 where each dotted line section 140A–140F of rotor blade 14 is an airfoil-shaped, radial cross-section of rotor blade 14. Section 140A can be considered to define the blade root, sections 140B–140E can be considered to define the blade span, and section 140F can be considered to define the blade tip.

In the present invention, all leading edges 142A–142F are aligned along a straight line 30 that extends outward from the periphery of hub 12. That is, all of leading edges 142A–142F are fixed along straight line 30 so that the resulting leading edge 14L of rotor blade 14 extends along a straight ruled edge and outward from the periphery of hub 12. Straight line 30 can be, but need not be, aligned with a radial line extending out from the axis of rotation of hub 12.

Although leading edges 142A–142F are fixed along straight line 30, each adjacent radial section of rotor blade 14 is rotated slightly about straight line 30. As a result, the blade's trailing edge 14T is twisted relative to straight line 30. The collective amount of rotation from blade section 140A to blade section 140F is illustrated in FIG. 5 where the angle of rotation $\delta$ between sections 140A and 140F is exaggerated for purpose of illustration. Typically, angle of rotation $\delta$ ranges from 5–20°. Note that the division of rotor blade 14 into discrete sections 140A–140F is done for descriptive purposes only as the actual rotor blade constructed in the above fashion will define a smooth surface from blade root to blade tip.

The arrangement of rotor blades 14 on hub 12 is another feature of the present invention. In particular, the rotor blades are irregularly spaced about hub 12 such that the angular spacing between leading edges is unequal when looking at adjacent rotor blades. In addition, when viewing rotor assembly 10 axially from either the front or back thereof, the leading edge of one rotor blade overlaps the trailing edge of the next adjacent rotor blade. This property is defined in the art as solidity where the presence of a leading edge to trailing edge overlap is defined as a solidity of greater than 1.

Referring now to FIG. 6, the irregular rotor blade spacing and solidity features are illustrated in the front or axial view of one embodiment of a rotor assembly having thirteen rotor blades 14. The leading edge of each rotor blade is indicated at 14L and the trailing edge is indicated by dashed lines at 14T. For clarity of illustration, only a few of rotor blades 14 have their leading and trailing edges so-indicated. The unequal angular spacing between the leading edges of rotor blades 14 is illustrated for one half of the rotor assembly with the angular spacing of the other half being mirror-imaged about dashed-line 32.

Figure 7:
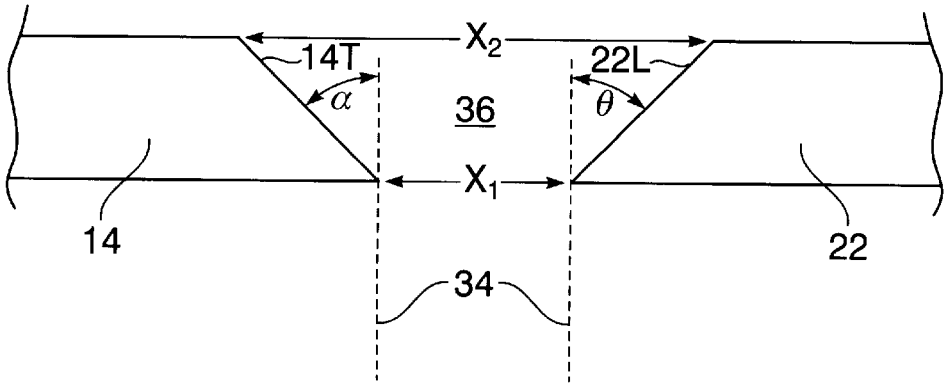
FIG. 7 is an expanded and isolated side view of a rotor blade and stator vane depicting their axial spacing relationship in accordance with the present invention.

The trailing edge 14T of each rotor blade 14 and the leading edge 22L of each stator vane 22 are sloped from vertical in the radial plane of the fan assembly. This is shown in the expanded and isolated side view of a rotor blade 14 and stator vane 22 illustrated in FIG. 7. Specifically, trailing edge 14T of rotor blade 14 is skewed axially forward from the straight-line radial direction (indicated by dashed-line 34) by a skew angle $\alpha$. The origin of radial direction 34 is the axis of rotation of the fan's rotor assembly. Leading edge 22L of stator vane 22 is slanted axially rearward from straight-line radial direction 34 by an inclined angle $\Theta$. The relationship between skew angle $\alpha$ and inclined angle $\Theta$ is, in general, such that an axial spacing or gap 36 between trailing edge 14T and leading edge 22L increases from $X_1$ to $X_2$ with radial distance from the center of hub 12. The minimum of axial gap 36, i.e., the minimum value of $X_1$, should be equal to or greater than the axial chord length of a central portion of rotor blade 14. That is, the length defining the minimum axial gap is the chord length of rotor blade 14 at the midpoint of its blade span when measured parallel to the fan rotor assembly's rotational axis.

An included or passing angle $\lambda$ is defined as the algebraic sum of skew angle $\alpha$ and inclined angle $\Theta$, and should be within the range of 60–75°. Typically, skew angle $\alpha$ is in the range of 30–50° and inclined angle $\alpha$ is in the range of 20–30°.

Figure 8:
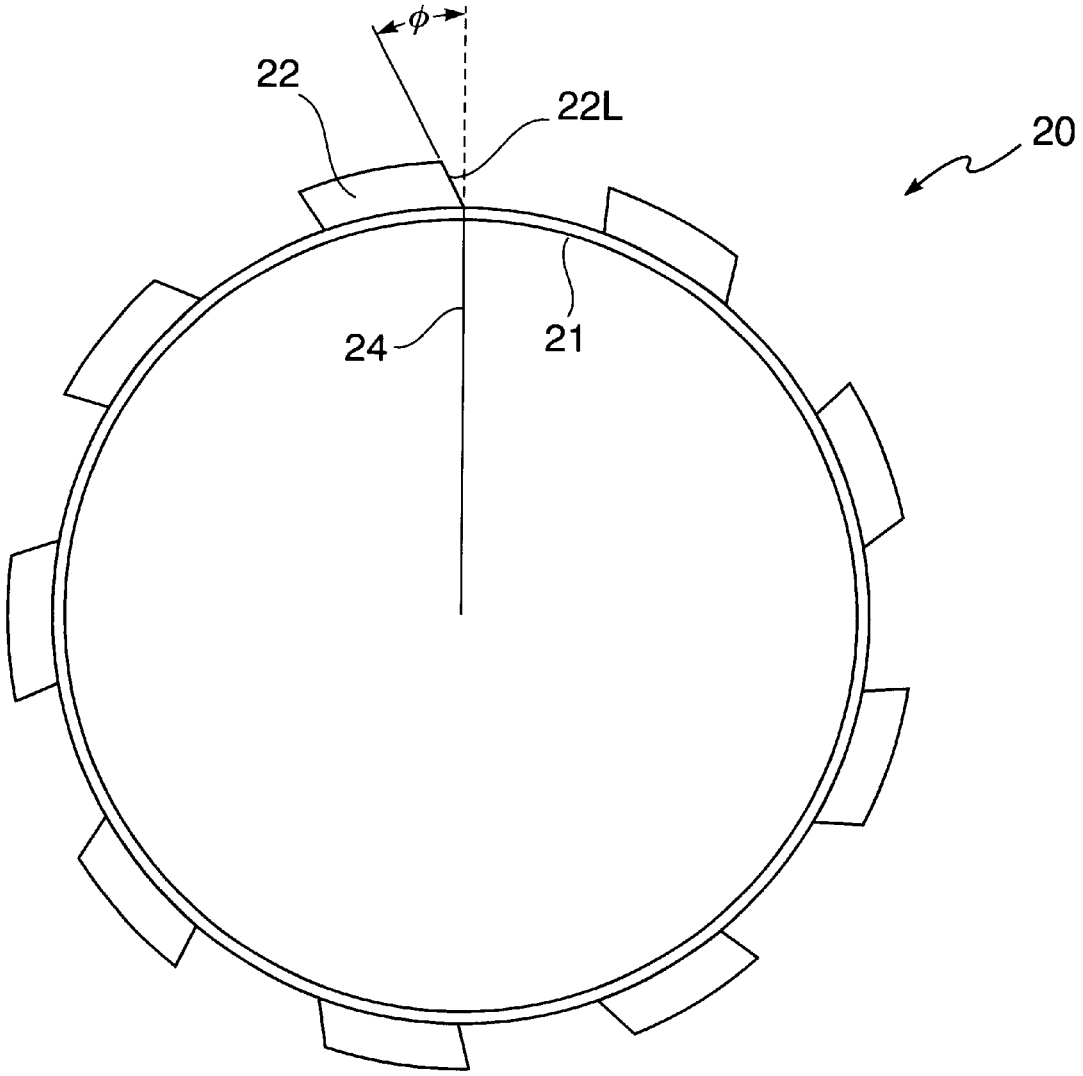
FIG. 8 is an isolated front or axial view of one embodiment of the stator assembly illustrating the lean angle that the leading edge of each stator vane makes with respect to a radius of the stator assembly.

As illustrated in the isolated front or axial view of stator assembly 20 in FIG. 8, the leading edge 22L of each stator vane 22 is also angled from hub to tip by a lean angle $\phi$. Lean angle $\phi$ lies in an axial plane of stator assembly 20 and is measured with respect to a radius 24 of stator assembly 20. The origin of radius 24 is the axis of rotation of the fan's rotor assembly. In the present invention, lean angle $\phi$ can range between 20° and 30°.

The number of rotor blades 14 in relation to stator vanes 22 is also important in the present invention. In general, it has been found that the rotor blades 14 should be less heavily aerodynamically loaded than stator vanes 22. This is accomplished by providing more rotor blades 14 than stator vanes 22 so that aerodynamic load can be spread over a greater number of rotor blades as compared to stator vanes. More specifically, it has been found that noise levels decrease when the number of rotor blades 14 is a small prime number that is approximately 1.5 times an odd number of stator vanes 22. For practical size and manufacturing considerations, the small prime number is typically between 3 and 37, i.e., one of 3, 5, 7, 11, 13, 17, 19 23, 29, 31 and 37. In an embodiment that produced good results in terms of increased efficiency and lower noise levels, the number of rotor blades is thirteen and the number of stator vanes is nine.

The advantages of the present invention are numerous. Efficiency is increased while noise levels are decreased by the fan assembly of the present invention. The benefits result from the design of each rotor blade, the arrangement of the rotor blades, the spacing relationship between the rotor blades and stator vanes, and the number of rotor blades as compared to the number of stator vanes.

Although the invention has been described relative to a specific embodiment thereof, there are numerous variations and modifications that will be readily apparent to those skilled in the art in light of the above teachings. For example, airfoil shapes other than the NACA-65 series could be used as the basis for each rotor blade, although design parameter specifics (e.g., chord length, camber, blade thickness, pitch, solidity, rotor-stator axial spacing, skew angle, etc.) would be different. It is therefore to be understood that, within the scope of the appended claims, the invention may be practiced other than as specifically described.

What is claimed as new and desired to be secured by Letters Patent of the United States is:

1. A fan assembly comprising:

a hub having an axis of rotation;

a plurality of rotor blades disposed circumferentially around and extending radially outward from said hub, each of said plurality of rotor blades having a straight-ruled leading edge that extends outward from said hub with unequal angular spacing between said leading edge of adjacent ones of said plurality of rotor blades, each of said plurality of rotor blades having a trailing edge that extends from said hub at a skew angle measured in a radial plane of said hub with respect to a first line extending radially outward from said axis of rotation, each of said plurality of rotor blades having an axial chord length defined across a central portion thereof and parallel to said axis of rotation, said plurality of rotor blades further defining a solidity of greater than 1;

a frame;

a plurality of stator vanes disposed circumferentially around and extending radially from said frame, said plurality of stator vanes being lesser in number than said plurality of rotor blades, each of said plurality of stator vanes having a leading edge that extends from said frame at: i) an inclined angle measured in said radial plane with respect to a second line extending radially outward from said axis of rotation, and ii) a lean angle measured in an axial plane of said frame with respect to a third line extending radially outward from said axis of rotation; and said frame with said plurality of stator vanes being positioned adjacent said hub with said plurality of rotor blades to define an axial gap between said trailing edge of each of said plurality of rotor blades and said leading edge of each of said plurality of stator vanes, said axial gap increasing with radial distance from said hub as defined by said skew angle and said inclined angle, said axial gap being a minimum of said axial chord length.

2. A fan assembly as in claim 1 wherein each of said plurality of rotor blades has a leading edge to trailing edge cross-section defined by a NACA-65 series airfoil shape.

3. A fan assembly as in claim 2 wherein each of said plurality of rotor blades is modified to have a leading edge profile that deviates from said NACA-65 series airfoil shape.

4. A fan assembly as in claim 2 wherein each of said plurality of rotor blades is modified to have a trailing edge profile that deviates from said NACA-65 series airfoil shape.

5. A fan assembly as in claim 2 wherein each of said plurality of rotor blades is modified to have a leading edge profile and a trailing edge profile that deviate from said NACA-65 series airfoil shape.

6. A fan assembly as in claim 1 wherein said angle of rotation ranges between 5–20°.

7. A fan assembly as in claim 1 wherein said skew angle ranges between 30–50°.

8. A fan assembly as in claim 1 wherein said inclined angle ranges between 20–30°.

9. A fan assembly as in claim 1 wherein said lean angle ranges between 20–30°.

10. A fan assembly as in claim 1 wherein a sum of said skew angle and said inclined angle define a passing angle that ranges between 60–75°.

11. A fan assembly as in claim 1 wherein said plurality of rotor blades comprises a quantity that is a prime number.

12. A fan assembly as in claim 11 wherein said prime number is selected from the group of prime numbers consisting of 3, 5, 7, 11, 13, 17, 19, 23, 29, 31 and 37.

13. A fan assembly as in claim 1 wherein said plurality of stator vanes comprises a quantity that is an odd number.

14. A fan assembly as in claim 1 wherein said plurality of rotor blades comprises a quantity that is a prime number selected from the group of prime numbers consisting of 3, 5, 7, 11, 13, 17, 19, 23, 29, 31 and 37, and wherein said plurality of stator vanes comprises a quantity that is an odd number.

15. A fan assembly as in claim 14 wherein said prime number is approximately 1.5 times said odd number.

16. A fan assembly as in claim 11 wherein said prime number is thirteen.

17. A fan assembly as in claim 13 wherein said odd number is nine.

18. A fan assembly as in claim 14 wherein said prime number is thirteen and said odd number is nine.

19. A fan assembly comprising:

a hub having a center axis about which said hub rotates;

a plurality of rotor blades disposed circumferentially around and extending radially outward from said hub with unequal angular spacing between adjacent ones of said plurality of rotor blades, each of said plurality of rotor blades having a blade root joined to said hub and a blade tip with a blade span formed between said blade root and said blade tip wherein each of said blade root, said blade tip and cross-sections of said blade span parallel to said blade root is defined by a NACA-65 airfoil shape having a leading edge and a trailing edge;

wherein, for each of said plurality of rotor blades, said leading edge associated with said blade root, said blade tip and said blade span is aligned along a straight line extending outward from said hub, said straight line defining a rotor blade leading edge, said straight line further defining an axis of rotation about which said blade span and said blade tip are rotated;

wherein, for each of said plurality of rotor blades, said trailing edge associated with said blade root, said blade tip and said blade span combine to define a rotor blade trailing edge that extends from said hub at a non-perpendicular skew angle at a skew angle measured in a radial plane of said hub with respect to a first line extending radially outward from said center axis;

said plurality of rotor blades further defining a solidity of greater than 1;

each of said plurality of rotor blades having an axial chord length defined across a central portion of said blade span and parallel to said center axis;

a frame;

a plurality of stator vanes disposed circumferentially around and extending radially from said frame, said plurality of stator vanes being lesser in number than said plurality of rotor blades, each of said plurality of stator vanes having a leading edge that extends from said frame at: i) an inclined angle measured in said radial plane with respect to a second line extending radially outward from said center axis, and ii) a lean angle measured in an axial plane of said frame with respect to a third line extending radially outward from said center axis; and said frame with said plurality of stator vanes being positioned adjacent said hub with said plurality of rotor blades to define an axial gap between each said rotor blade trailing edge and said leading edge of each of said plurality of stator vanes, said axial gap increasing with radial distance from said center axis as defined by said skew angle and said inclined angle, said axial gap being a minimum of said axial chord length.

20. A fan assembly as in claim 19 wherein each of said plurality of rotor blades is modified to have a leading edge profile that deviates from said NACA-65 series airfoil shape.

21. A fan assembly as in claim 19 wherein each of said plurality of rotor blades is modified to have a trailing edge profile that deviates from said NACA-65 series airfoil shape.

22. A fan assembly as in claim 19 wherein each of said plurality of rotor blades is modified to have a leading edge profile and a trailing edge profile that deviate from said NACA-65 series airfoil shape.

23. A fan assembly as in claim 19 wherein said angle of rotation ranges between 5–20°.

24. A fan assembly as in claim 19 wherein said skew angle ranges between 30–50°.

25. A fan assembly as in claim 19 wherein said inclined angle ranges between 20–30°.

26. A fan assembly as in claim 19 wherein said lean angle ranges between 20–30°.

27. A fan assembly as in claim 19 wherein a sum of said skew angle and said inclined angle define a passing angle that ranges between 60–75°.

28. A fan assembly as in claim 19 wherein said plurality of rotor blades comprises a quantity that is a prime number.

29. A fan assembly as in claim 28 wherein said prime number is selected from the group of prime numbers consisting of 3, 5, 7, 11, 13, 17, 19, 23, 29, 31 and 37.

30. A fan assembly as in claim 19 wherein said plurality of stator vanes comprises a quantity that is an odd number.

31. A fan assembly as in claim 19 wherein said plurality of rotor blades comprises a quantity that is a prime number selected from the group of prime numbers consisting of 3, 5, 7, 11, 13, 17, 19, 23, 29, 31 and 37, and wherein said plurality of stator vanes comprises a quantity that is an odd number.

32. A fan assembly as in claim 31 wherein said prime number is approximately 1.5 times said odd number.

33. A fan assembly as in claim 28 wherein said prime number is thirteen.

34. A fan assembly as in claim 30 wherein said odd number is nine.

35. A fan assembly as in claim 31 wherein said prime number is thirteen and said odd number is nine.

* * * * *